US006068540A

United States Patent [19]

Dickenscheid et al.

[11] Patent Number: 6,068,540

[45] Date of Patent: May 30, 2000

[54] POLISHING DEVICE AND POLISHING CLOTH FOR SEMICONDUCTOR SUBSTRATES

[75] Inventors: Wolfgang Dickenscheid; Goetz Springer, both of Dresden, Germany

[73] Assignee: Siemens Aktiengesellschaft, Munich, Germany

[21] Appl. No.: 09/080,912

[22] Filed: May 18, 1998

[30] Foreign Application Priority Data

May 16, 1997 [DE] Germany ..... 197 20 623

[51] Int. Cl.[7] ..... B24D 7/22

[52] U.S. Cl. ..... 451/6; 451/537

[58] Field of Search ..... 451/6, 41, 287, 451/288, 533, 537, 538

[56] References Cited

U.S. PATENT DOCUMENTS

| | | | |
|---|---|---|---|
| 5,433,651 | 7/1995 | Lustig et al. | 451/6 |
| 5,486,129 | 1/1996 | Sandhu et al. | 451/10 |
| 5,609,511 | 3/1997 | Moriyama et al. | 451/5 |
| 5,609,719 | 3/1997 | Hempel | 156/636.1 |
| 5,838,447 | 11/1998 | Hiyama et al. | 451/6 |
| 5,893,796 | 4/1999 | Birang et al. | 451/526 |

FOREIGN PATENT DOCUMENTS

| | | | |
|---|---|---|---|
| 3234467 | 10/1991 | Japan | 451/6 |

*Primary Examiner*—Robert A. Rose
*Attorney, Agent, or Firm*—Herbert L. Lerner; Laurence A. Greenberg; Werner H. Stemer

[57] ABSTRACT

The polishing device grinds or polishes semiconductor substrates. The device includes a polishing table, into which a measuring device is integrated and a through opening. A polishing cloth covers the polishing table. The polishing cloth has at least one opening formed therein which corresponds to the through opening in the polishing table. The invention also relates to a polishing cloth for use in the polishing device.

11 Claims, 1 Drawing Sheet

POLISHING DEVICE AND POLISHING CLOTH FOR SEMICONDUCTOR SUBSTRATES

BACKGROUND OF THE INVENTION

Field of the Invention

The invention relates to a polishing device and a polishing cloth for grinding or polishing semiconductor substrates and in particular for machining semiconductor substrates, in which end point control of the grinding or polishing operation is necessary.

Typical devices for grinding or polishing wafer surfaces, trench fillings, metal plugs, interoxide layers or the like of semiconductor substrates generally include a rotatable polishing table with an elastic overlay which is also called a polishing cloth or pad. A polishing agent is typically applied to the polishing cloth. In chemical-mechanical polishing (CMP), the polishing agent includes not only grinding or polishing particles but also chemical additives, which are selected on the basis of which layer is to be removed. The chemical agents reinforce the removal process.

The semiconductor substrate to be machined, for instance a silicon wafer, is generally guided on the polishing table by a rotating carrier that rotates in the opposite direction from the polishing table.

To enable selective control of the grinding or polishing operation, the polishing device generally includes a measuring device with which the end point of the machining can be ascertained. Examples of such measuring devices are optical devices for determining the layer thickness or the removal rate, or devices for temperature determination by means of infrared detectors. Often, the measuring device is integrated into the polishing table. In that case, a window is provided above the measuring device in the polishing cloth, the window being transparent to the wavelength range employed in the measurement. In order not to impair the polishing operation, it is thereby necessary to adapt the window material to the material which forms the polishing cloth. The way in which the window is integrated into the polishing cloth must also be such that the quality and service life of the windowed polishing cloth is substantially equivalent to that of a normal polishing cloth for a CMP process. It should also withstand the same mechanical and chemical stresses.

Windowed polishing cloths of this kind as a rule comprise an upper polishing cloth into which a window of transparent plastic is integrated, and a polishing cloth lying beneath it. The window material has mechanical properties comparable to those of the upper polishing cloth. The transparent window is typically larger than the associated opening in the polishing cloth below and is glued to the opening edge of the lower polishing cloth.

By way of example, such an configuration is available as a windowed polishing cloth IC1000 on a SUBAIV polishing cloth, both made by the Rodel company (stacked pad).

The prior art windowed polishing cloths are hard polishing cloths, which while they have good planarizing properties nevertheless readily cause scratches in the substrate. Such hard polishing cloths are therefore used primarily in an initial polishing stage for removing relatively large layer thicknesses. After that, the thus-treated substrate is repolished with a soft polishing cloth in a second polishing stage, in order to remove scratches. However, if only slight layer thicknesses are to be removed, then hard polishing cloths can generally not be used. In that case, soft polishing cloths must be used from the very beginning. Inserting windows into such soft polishing cloths is problematic, however, and reliable soft polishing cloths with an integrated window of plastic material are not currently available. This means that prior to this invention even a combination of a polishing table with an integrated optical measuring device and a soft polishing cloth with an integrated window could not be used.

SUMMARY OF THE INVENTION

It is accordingly an object of the invention to provide a polishing device and polishing cloth for polishing semiconductor substrates, which overcomes the above-mentioned disadvantages of the prior art devices and methods of this general type and which provides for a polishing device with a measuring device integrated into the polishing table that can also be used in conjunction with a soft polishing cloth. It is a further object to provide a polishing cloth suitable for use with such a polishing device.

With the foregoing and other objects in view there is provided, in accordance with the invention, a polishing device, comprising:

- a polishing table formed with a measuring device cavity and having a through opening formed therein;
- a measuring device disposed in the measuring device cavity; and
- a polishing cloth disposed on the polishing table, the polishing cloth having an opening formed therein substantially aligned with the through opening.

In accordance with an added feature of the invention, the polishing cloth is a soft polishing cloth.

With the above and other objects in view there is also provided, in accordance with the invention, a of a polishing cloth assembly and a polishing device having a polishing table, a measuring device in the polishing table, and being formed with a through opening exposing the measuring device towards a support surface on the polishing table. The polishing cloth assembly is to be placed on the support surface on the polishing table and it comprises a polishing cloth with an opening formed therein substantially aligned with the through opening in the polishing table.

In other words, the invention relates to a polishing device with a polishing table into which a measuring device is integrated in a conventional manner. The term "polishing device" as used here is meant to include both polishing devices and grinding devices. The polishing table is equivalent to the polishing tables conventionally employed in the field of semiconductor technology. The measuring device is preferably an optical measuring device, such as one for measuring the layer thickness, the removal rate, or the temperature with the aid of infrared detectors.

On the side of the polishing table onto which the polishing cloth is applied, the polishing table has a region permeable to the measuring wavelength, or an opening, above the measuring device. Both variants are referred to herein in summary fashion as a "through openings."

The polishing cloth which is disposed on the polishing table of the polishing device of the invention differs from the conventional prior art polishing cloths in that it does not include a window of transparent material. Instead it has at least one opening formed therein. The opening is disposed in the polishing cloth so as to correspond with the position of the through opening for the measuring device in the polishing table. If there are a plurality of measuring devices in the polishing table, then-correspondingly many recesses may be formed in the polishing cloth of the invention.

Quite surprisingly, the inventors have demonstrated that the windows of transparent material previously integrated into the polishing cloth are not necessary. Instead, they can be replaced by unfilled recesses or openings without any impairment to the grinding or polishing operation and without shortening the service life of the polishing cloths. The edges of the openings do not cause any scratches on the substrate, and uniform grinding and polishing results are attained, similar to those observed in polishing processes in which a wafer is repeatedly moved across the edge of a polishing cloth.

The polishing cloths of the invention can be produced very simply. Any type of polishing cloth can be used, including soft polishing cloths of the kind typically used to remove scratches, since the polishing cloths of the invention are not dependent on particular combinations of material. With regard to the selection of material, all the materials conventionally used for grinding or polishing cloths can be employed for the polishing cloths of the invention.

In accordance with another feature of the invention, the polishing cloth is glued to the polishing table. In other words, it is possible to secure the polishing cloth directly to the polishing table.

In accordance with a further feature of the invention, a transparent film is disposed between the polishing cloth and the polishing table. In a preferred embodiment, the transparent film is glued to the polishing table and/or to the polishing cloth. The film is transparent with regard to the applicable measurement wavelength. It may for instance be a plastic film that is glued to both the polishing table and the polishing cloth. An adhesive film may also be used. The films enable particularly simple fastening. Moreover, they protect the measuring device against the penetration of polishing agent.

In accordance with an additional feature of the invention, the polishing cloth has ducts formed in a surface thereof remote from the polishing table. Preferably, the ducts extend from the opening to an edge of the polishing cloth. This feature prevents polishing agent from collecting in the at least one opening or recess in the polishing cloth of the invention. Through these ducts, the polishing agent is carried to the outside, to the edge of the polishing cloth, by centrifugal (i.e., centripetal) forces during the polishing operation. The ducts expediently extend radially outward from the recess.

The ducts may be cut, stamped or press-fitted into place, for example. The size and number of ducts depends on the type of polishing device and on the polishing agent used, as well as on the size of the opening in the cloth.

Other features which are considered as characteristic for the invention are set forth in the appended claims.

Although the invention is illustrated and described herein as embodied in a polishing device and polishing cloth for semiconductor substrates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
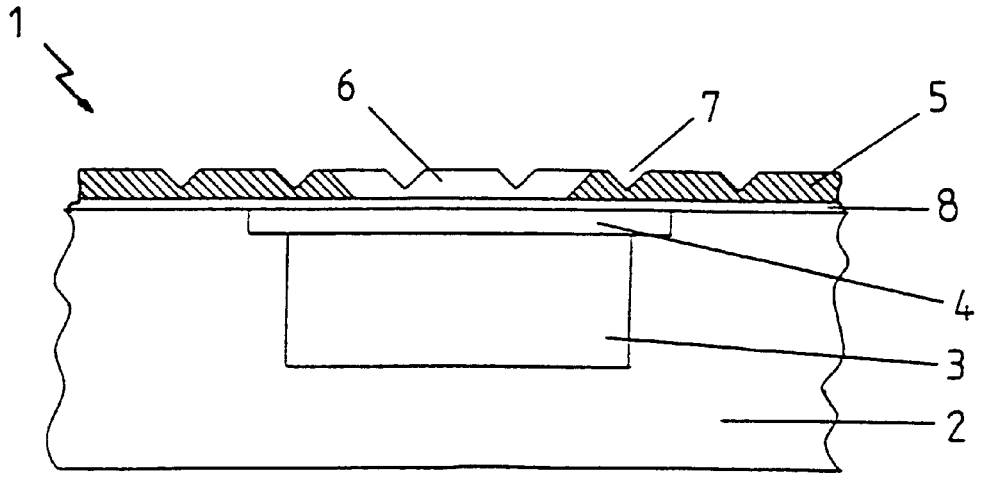
FIG. 1 is a schematic radial cross section showing a polishing device according to the invention.

Referring now to the figure of the drawing in detail there is seen a polishing device 1 of the invention which includes a polishing table 2 into which a measuring device 3 is integrated. Above the measuring device 3, in the direction toward the polishing cloth 5, there is formed a window 4 that is permeable to the detector wavelength. A transparent film 8 that protects the measuring device 3 against the penetration of polishing agent is glued in place between the polishing table 2 and the polishing cloth 5. Above the window 4, the polishing cloth 5 has an opening 6 that makes the contact possible between the measuring device 3 and the article to be machined. The non-illustrated article to be polished is placed on the polishing cloth 5. To prevent an accumulation of polishing agent in the recess 6, which would make measurement difficult or impossible, the polishing cloth is formed with ducts 7, which carry polishing agent from the recess 6 to the edge of the polishing cloth.

We claim:

1. A polishing device, comprising:

a polishing table formed with a measuring device cavity, said polishing table having a table opening in communication with said measuring device cavity;

a measuring device disposed in said measuring device cavity;

a polishing cloth disposed on said polishing table, said polishing cloth having an opening formed therein substantially aligned with said table opening; and a transparent film disposed between said polishing cloth and said polishing table.

2. The polishing device according to claim 1, wherein said polishing cloth is a soft polishing cloth.

3. The polishing device according to claim 1, wherein said polishing cloth has ducts formed in a surface thereof remote from said polishing table.

4. The polishing device according to claim 3, wherein said ducts extend from said opening to an edge of said polishing cloth.

5. The polishing device according to claim 1, wherein said polishing cloth is glued to said polishing table.

6. The polishing device according to claim 1, wherein said transparent film is glued to said polishing table and to said polishing cloth.

7. In combination with a polishing device having a polishing table, a measuring device in the polishing table, and being formed with a table opening exposing the measuring device towards a support surface on the polishing table, a polishing cloth assembly to be placed on the support surface on the polishing table, the polishing cloth assembly comprising:

a soft polishing cloth layer having an opening formed therein substantially aligned with the table opening; and a transparent film disposed between said polishing cloth layer and the polishing table.

8. The polishing cloth assembly according to claim 7, wherein said transparent film is glued to the polishing table and to said polishing cloth layer.

9. The polishing cloth assembly according to claim 7, wherein said polishing cloth layer has ducts formed in a surface thereof remote from the polishing table.

10. The polishing cloth assembly according to claim 9, wherein said ducts extend from said opening to an edge of said polishing cloth layer.

11. The polishing cloth assembly according to claim 7, wherein said polishing cloth layer is glued to the polishing table.

* * * * *